US007489285B2

(12) United States Patent
Eckstein et al.

(10) Patent No.: US 7,489,285 B2
(45) Date of Patent: Feb. 10, 2009

(54) COLLAPSIBLE ELECTRONIC ARTICLE SURVEILLANCE GATE

(75) Inventors: Eric Eckstein, Merion Station, PA (US); Michael Rapp, Modautal, DE (US)

(73) Assignee: Checkpoint Systems, Inc., Thorofare, NJ (US)

( * ) Notice: Subject to any disclaimer, the term of this patent is extended or adjusted under 35 U.S.C. 154(b) by 80 days.

(21) Appl. No.: 11/252,519

(22) Filed: Oct. 18, 2005

(65) Prior Publication Data

US 2006/0082510 A1 Apr. 20, 2006

Related U.S. Application Data

(60) Provisional application No. 60/620,475, filed on Oct. 20, 2004.

(51) Int. Cl.
*H01Q 1/08* (2006.01)
*H01Q 1/04* (2006.01)

(52) U.S. Cl. ..... 343/880; 343/881; 343/883; 343/719; 343/890; 343/900; 343/915

(58) Field of Classification Search ..... 343/880, 343/881, 888, 900, 915, 916, 719
See application file for complete search history.

(56) References Cited

U.S. PATENT DOCUMENTS

| | | | | |
|---|---|---|---|---|
| 1,689,400 | A * | 10/1928 | Manley | 343/868 |
| 5,313,221 | A | 5/1994 | Denton, Jr. | |
| 5,585,160 | A * | 12/1996 | Osthassel | 428/66.5 |
| 5,825,335 | A | 10/1998 | Arai et al. | |
| 6,271,756 | B1 | 8/2001 | Davies, Jr. | |
| 6,369,773 | B2 | 4/2002 | Kashiwagi et al. | |
| 7,126,553 | B1 * | 10/2006 | Fink et al. | 343/767 |
| 2001/0007444 | A1 * | 7/2001 | Porter et al. | 343/716 |
| 2005/0229451 | A1 * | 10/2005 | Mullens et al. | 40/500 |
| 2005/0285807 | A1 * | 12/2005 | Zehngut et al. | 343/719 |
| 2006/0290498 | A1 * | 12/2006 | Rawlings et al. | 340/572.1 |

FOREIGN PATENT DOCUMENTS

| | | | |
|---|---|---|---|
| FR | 2 809 279 | A1 | 11/2001 |
| FR | 2 843 806 | A1 | 2/2004 |
| GB | 2 120 857 | A | 12/1983 |
| WO | WO 2004/084346 | A1 | 9/2004 |

OTHER PUBLICATIONS

International Search Report, dated Mar. 10, 2006, for International Application No. PCT/US2005/037432.

* cited by examiner

*Primary Examiner*—Trinh V Dinh
(74) *Attorney, Agent, or Firm*—Caesar, Rivise, Bernstein, Cohen & Pokotilow, Ltd.

(57) ABSTRACT

A stowable antenna system for a security system is providing which includes an electronic radiating element in the form of a furlable flexible sheet, a power supply to power the electronic radiating element and a housing to receive and store the radiating element in a furled condition. The radiating element may be extended to an unfurled condition for use in the security system. One or more risers may extend from the housing for supporting the radiating element in the unfurled condition. The electronic radiating element may be received in the housing and stored in the housing in a rolled up, windowshade configuration.

2 Claims, 5 Drawing Sheets

COLLAPSIBLE ELECTRONIC ARTICLE SURVEILLANCE GATE

CROSS-REFERENCE TO RELATED APPLICATION

This application claims priority to U.S. Provisional Application Ser. No. 60/620,475, entitled Collapsible Electronic Article Surveillance Gate, filed Oct. 20, 2004, by Michael Rapp and Eric Eckstein.

SPECIFICATION

BACKGROUND OF THE INVENTION

The present invention relates generally to electronic security systems such as electronic article security (EAS) or radio frequency identification tag (RFID) systems for detecting the presence of a security tag within a security zone adjacent to system antennas, and, more particularly, to an improved antenna system structure for such a system that is portable and provides a secondary feature of providing interchangeable indicia thereon for advertising and the like.

A variety of electronic article surveillance systems have been proposed and implemented to restrict the unauthorized removal of articles from a particular premises. One common form of this is the electronic article surveillance system which has come to be placed near the exits of retail establishments, libraries and the like. However, electronic article surveillance systems are also used for purposes of process and inventory control, to track articles as they pass through a particular system, among other applications.

Irrespective of the application involved, such electronic article surveillance systems generally operate upon a common principle. Articles to be monitored are provided with tags (of various different types) which contain a circuit (a resonant circuit) for reacting with an applied radio-frequency field. A transmitter and a transmitting antenna are provided to develop this applied field, and a receiver and a receiving antenna are provided to detect disturbances in the applied field. Such transmitting and receiving antennas are generally located at or around points of exit from such facilities to detect the security tag, and thus the article, as it transits through the exit point. If the active circuit of a tag is passed between the transmitting and receiving antennas (which are generally placed near the point of exit from a given premises), the applied field is affected in such fashion that a detectable event is produced within the receiver. This is then used to produce an appropriate alarm. Systems of this general type are available from manufacturers such as Checkpoint Systems, Inc., of Thorofare, N.J., among others.

Due to environmental and regulatory considerations, individual systems are generally effective over only a limited area in which a security tag attached to a protected article may be reliably detected. Such an area, typically referred to as a security zone, may generally be limited to about six feet in width. While many stores and libraries have only a single exit doorway of a size commensurate with such a six foot wide security zone, many other retail establishments have eight or ten exit doorways arranged side by side. Furthermore, large mall stores frequently have a generally wide open area or aisle of ten feet or more in width serving as a connection with the mall. Thus, in many such situations, a plurality of systems are required to fully protect exit/entrance points having a width greater than that which can be reliably protected by a single system.

In a large mall entryway that needs to be protected, it is likely that the store owner will not want to employ a traditional system installation which would include multiple, large, side-by-side "pedestal" antenna structures, due to aesthetic visual or marketing reasons. Such store owners would typically prefer an invisible system in which the antenna structure is mounted in the floor beneath the entryway, hung over the entryway or both. Additionally, store owners would often prefer a system that is nonpermanent to allow for the antennas to easily be placed in different locations, or a system that may be only used on a part-time basis, but may be deployed as needed and otherwise be hidden.

Numerous patents address EAS and RFID systems. For example, U.S. Pat. No. 6,271,756 (Davies, Jr. et al.) teaches a security tag detection and localization system for detecting a resonant security tag in a security zone and generating an alarm signal. The security zone has a plurality of detection zones and includes an antenna array for radiating interrogation signals and receiving response signals. The antenna array forms the upper boundary, the lower boundary or both the upper and lower boundaries of a security zone and extends horizontally across the width and length of the security zone. The antenna array comprises at least two antennas. The antennas forming the upper and lower boundaries are disposed side-by-side in a single horizontal plane with each antenna being electromagnetically coupled to one of the detection zones. The security tag detection and localization system also includes one or more EAS sensors for transmitting interrogation signals to the antenna array, receiving response signals from the antenna array, and generating an alarm signal. The security tag detection and localization system also includes an annunciator connected to each EAS sensor, for receiving the alarm signal and indicating a detection zone corresponding to the alarm signal.

It would be desirable to provide a portable system. However, to this point, any portable system would necessitate the use of a system that is large and cumbersome to carry due to the large size of the required antennas.

Finally, sheet antennas are also well known. For example, U.S. Pat. No. 6,369,773 (Kashiwagi et al.) depicts a sheet antenna which comprises a substrate sheet, a layer of antenna element composed of a conductive material and a carbon-containing layer. The carbon-containing layer antenna element are laminated on the substrate. Here, the primary use according to this patent is for automobile use. This patent teaches the use of various plastic sheets and films, including, for example, polyolefins such as polypropylene, polyesters such as polyethylene, etc. However, sheet antennas adaptable for use for surveillance gates are not known.

All references cited herein are incorporated herein by reference in their entireties.

BRIEF SUMMARY OF THE INVENTION

A stowable antenna system for a security system is disclosed which includes an electronic radiating element in the form of a flexible sheet where the said flexible sheet is furlable, and a power supply to power the electronic radiating element. Preferably, the stowable antenna system includes a housing to receive and store the radiating element in a furled condition. Here, the radiating element is stowable in a furled condition and may be extended to an unfurled condition for use when the security system is activated. One or more risers extending from the housing may be used for supporting the radiating element in the unfurled condition. The risers may be telescopic risers that extends from the housing. The risers may be cables each extending between a fixed point adjacent to the housing and an edge of the electronic radiating element. The cable may extend between a ceiling that is over the housing and the edge of the electronic radiating element. In one preferred embodiment, the electronic radiating element is received in the housing and stored in the housing in a rolled up, windowshade configuration. The electronic radiating element may have printed indicia thereon such as advertising indicia. The electronic radiating element may be adapted to be easily replaceable in the housing. An alarm indicator light located adjacent to the electronic radiating element that is energized when a corresponding tag is present within a security zone created by the system.

The stowable antenna may be self contained and portable. The housing may be located under ground level. Here, preferably, the housing has a cover to provide access to unfurl the electronic radiating element to a position above the ground level. One or more separate thin sheets may be laid on the electronic radiating element. These thin sheets may include indicia and/or may contain colors or designs. The thin sheets may be adhered to the electronic radiating element with an adhesive. The adhesive is preferably a temporary adhesive.

At least one riser for supporting the radiating element in an unfurled condition extends upwardly from the housing. Alternatively, the riser or risers for supporting the radiating element in an unfurled condition may extend horizontally or downwardly from the housing. Finally, preferably, the power supply is operable utilizing standard 110 volt AC power (but may be operable by batteries or other types of supplies such as solar energy).

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
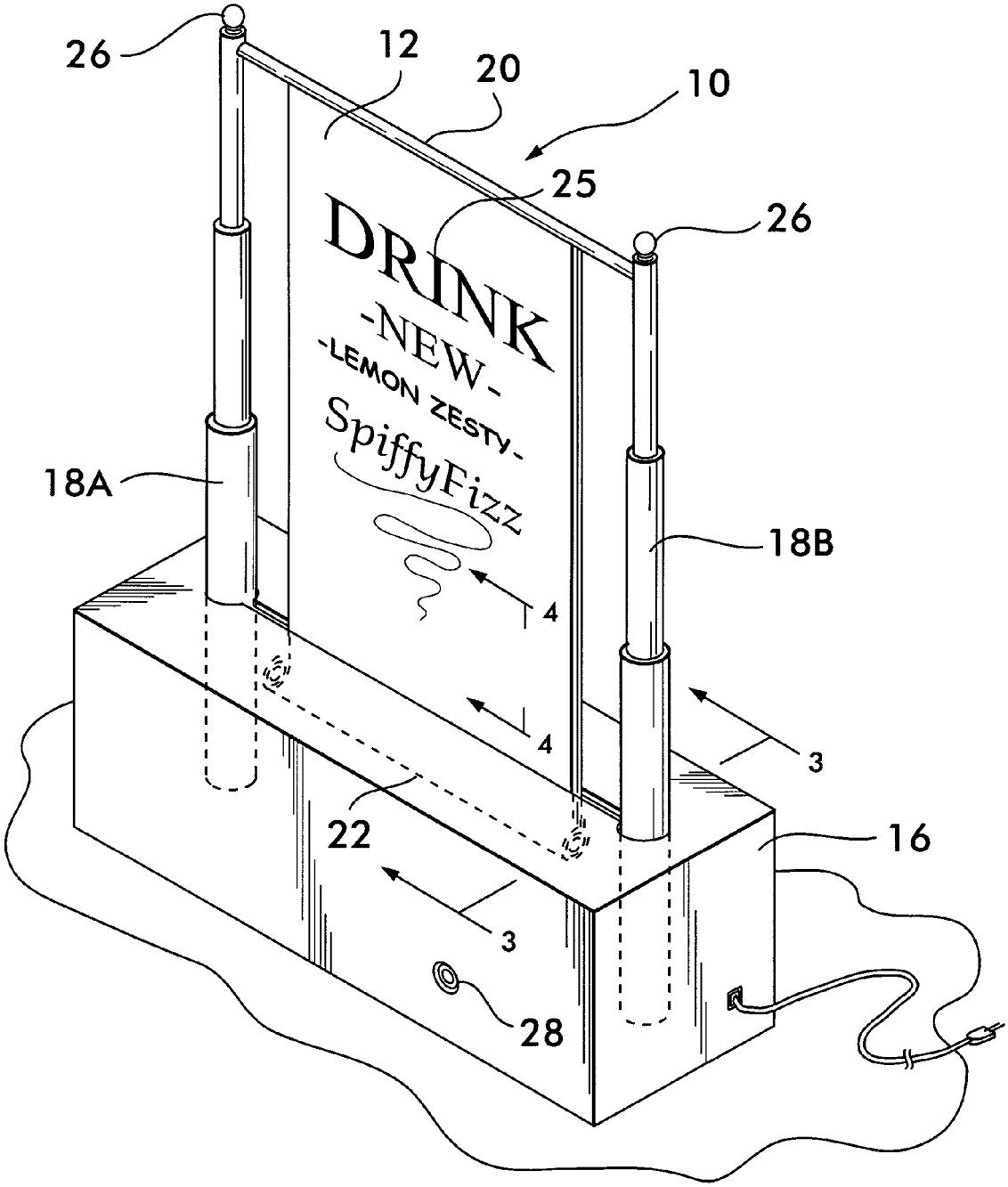
FIG. 1 is an isometric view of a stowable antenna system in accordance with a first preferred embodiment of the present invention, wherein a radiating element is shown in an unfurled condition.
Figure 2:
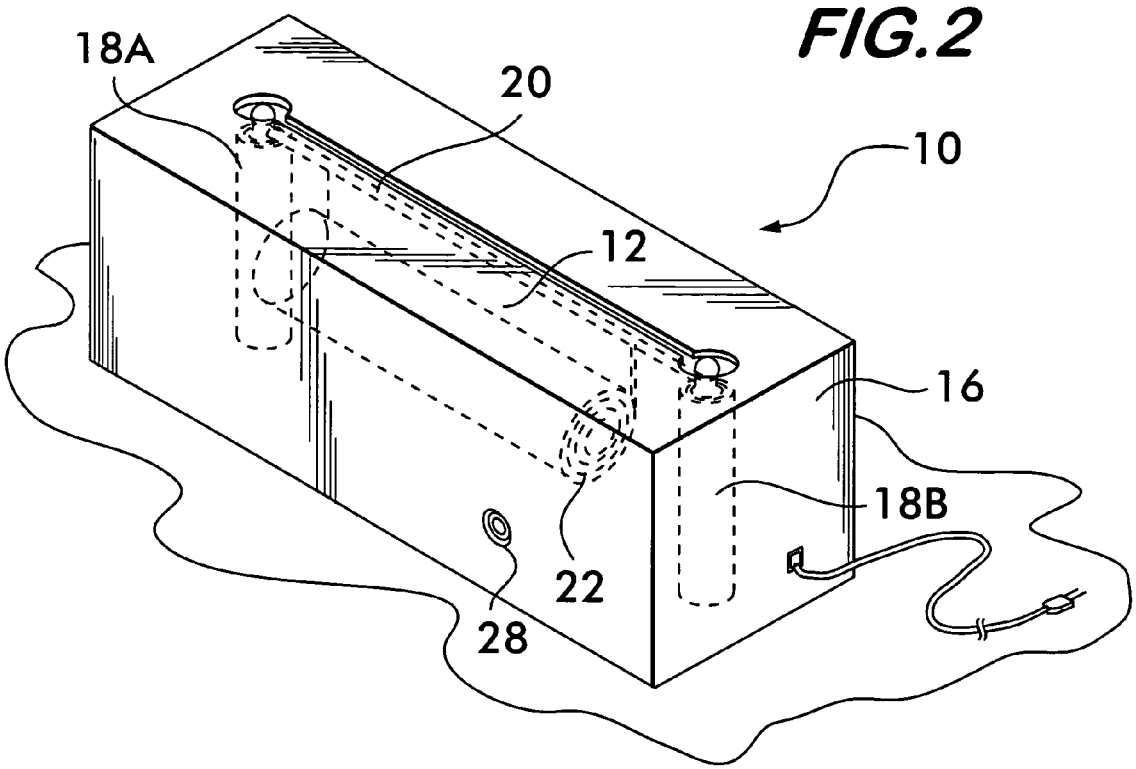
FIG. 2 is an isometric view of a housing for the stowable antenna system of FIG. 1, wherein a radiating element is shown in a furled condition.
Figure 3:
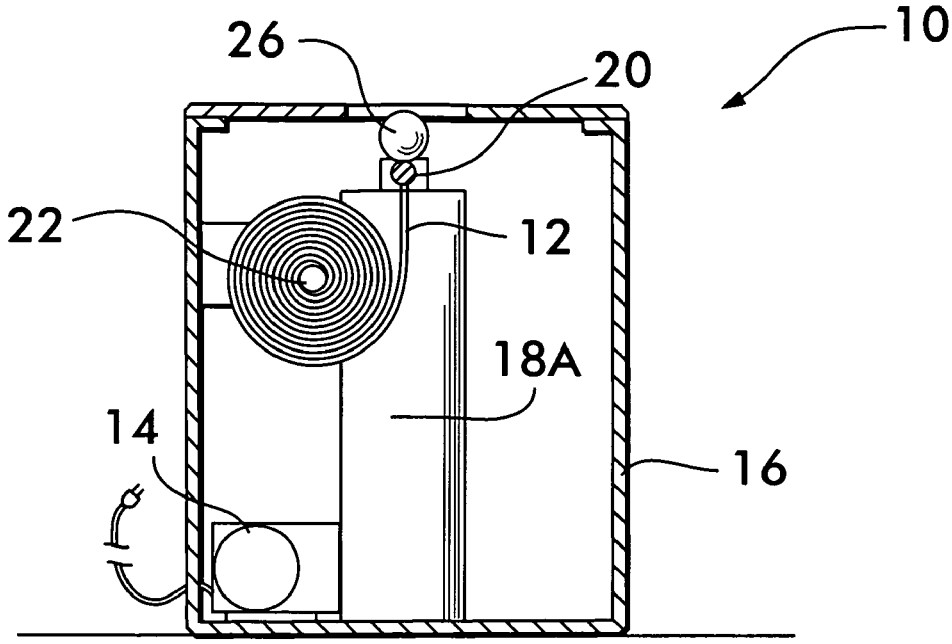
FIG. 3 is a cross-sectional view of the stowable antenna system of FIG. 1, taken substantially along lines 3-3 of FIG. 1.

Referring now to the drawings wherein like part numbers refer to like elements throughout the several views, there is shown in FIG. 1 a stowable antenna system 10 in accordance one preferred embodiment of the present invention. The stowable antenna system 10 includes an electronic radiating element, for example, in the form of a sheet antenna 12. It is intended that the electronic radiating element be broadly interpreted to be substantially any radiating element in a flexible sheet form that is foldable or furlable and that provides for communication of the radiating element with wireless devices (not shown), such as EAS or RFID tags at frequencies such as HF and UHF and microwave. Appropriate electronics are also included in the system (not shown) which are very well known and commonly available. A power supply 14 supplies power to the electronic radiating element 12. Additionally, the power supply may supply power to furl and unfurl the electronic radiating element 12. As can be seen in FIGS. 2 and 3, a housing 16 receives and stores the radiating element 12 in a furled condition. In the present system, "furled" is intended to be broadly construed to include rolled, folded or otherwise reduced in length to fit into to a small, low volume space.

When it is desired to deploy the electronic radiating element 12, at least one riser and preferably a pair of risers 18A, 18B extends from the housing 16 for supporting the radiating element 10 in an unfurled condition. In operation, when it is desired to deploy the radiating element 12, a user extends the risers 18A, 18B. The risers 18A, 18B may be telescopic such that the risers may be fully enclosed within the housing 16 when retracted. The risers may be automatically extendible. Once the risers 18A, 18B are fully extended (or while the risers are being extended), the radiating element 12 is pulled from within the housing 16 and extends to a point adjacent to the extended ends of the risers 18A, 18B. As shown in FIG. 1, the top of the radiating element 12 may be attached to a cross bar 20 to support the top of the radiating element 12 such that it is in a generally planar condition. Preferably, the housing 16 contains a windowshade-like apparatus 22 that provides for the radiating element 12 to be neatly furled in a rolled-up configuration and fully received within the housing 16.

Figure 4:
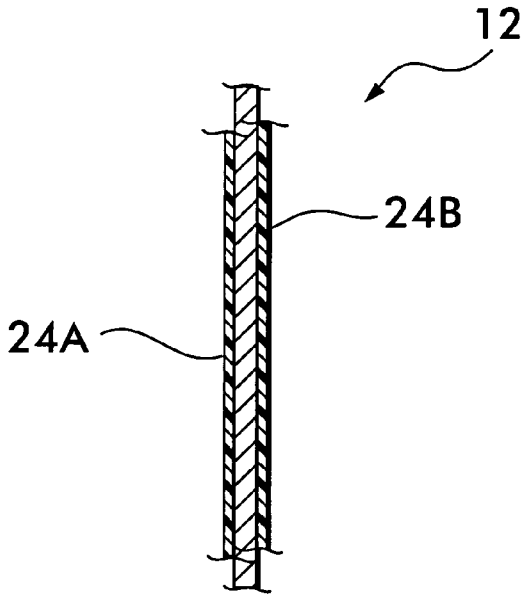
FIG. 4 is a cross sectional view of a one embodiment of an antenna for use in the stowable antenna system of FIG. 1, taken substantially along lines 4-4 of FIG. 1.

As seen in FIG. 1, the electronic radiating element 12 may have indicia 25 printed thereon, for example, in the form of advertising indicia. Optionally, as specifically seen in FIG. 4, the indicia 25 may be printed on at least one separate, thin sheet 24, for example a paper or a plastic film, laid on the electronic radiating element 12. That is, the thin sheet 24 is separate from the radiating element 12 such that different thin sheets with different indicia, such as different advertising graphics, or merely different colors, are easily interchangeable. As seen in FIG. 4, two thin sheets 24A and 24B are shown on either side of the radiating element 12. The thin sheets 24A, 24B may be adhered to the electronic radiating element 12, for example, with an adhesive, such as a temporary adhesive, that allows for the thin sheets 24A, 24B to be easily removed from the radiating element 12.

Preferably, similar to an actual windowshade that is commonly available and well known, the electronic radiating element 12 is easily replaceable in the housing 16. This is particularly beneficial where the indicia is printed directly on the electronic radiating element 12 and no separate thin sheets 24A, 24B are used.

The housing 16 or other location on the system 10 adjacent to the electronic radiating element, such as on a riser 18, may include an alarm indicator light 26 or audible alarm 28 such as a buzzer that is energized when an EAS or RFID tag or the like is present in within the appropriate range of the system 10.

Figure 6:
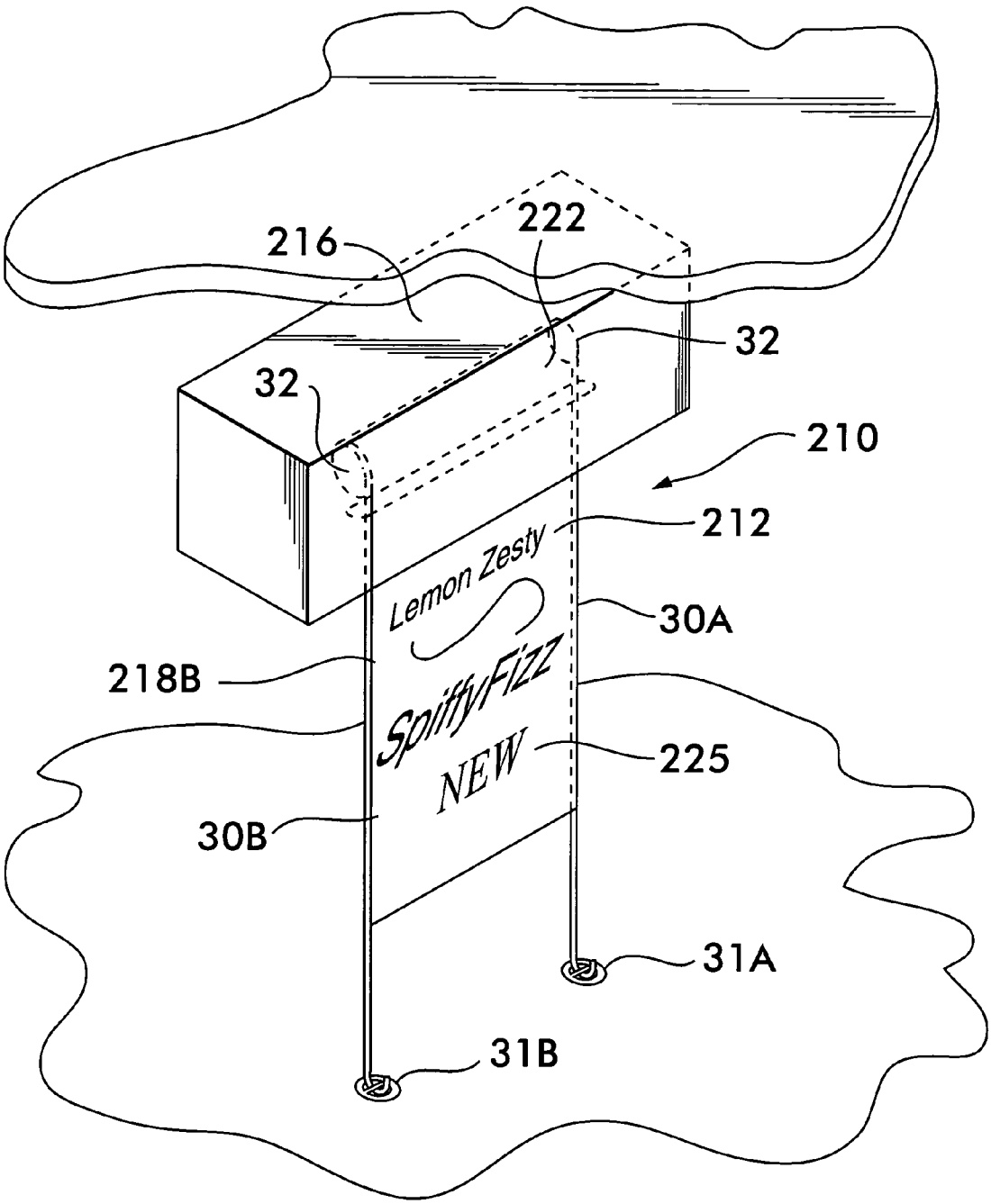
FIG. 6 is an isometric view of a stowable antenna system in accordance with a third preferred embodiment of the present invention, shown in a horizontally mounted configuration.

As seen in the alternate embodiment of FIG. 6, the risers may be in the form of cable risers 30A, 30B extending between a fixed point adjacent to or on the housing 216 and an edge of the electronic radiating element 212. In the embodiment of FIG. 6, for simplicity sake, like elements to that of the embodiment of FIG. 1 use the same reference number with a "2" as a prefix. For example, the housing of FIG. 1 was designated 16. The housing of FIG. 6 is designated 216. The end of each cable riser 30A, 30B may include a hook 31A, 31B to secure the cable riser 30A, 30B to a floor (FIG. 6), ceiling, wall, or other rigid surface. As seen in FIG. 6, the cable risers 30A, 30B may retract into the housing on rollers 32.

Figure 7:
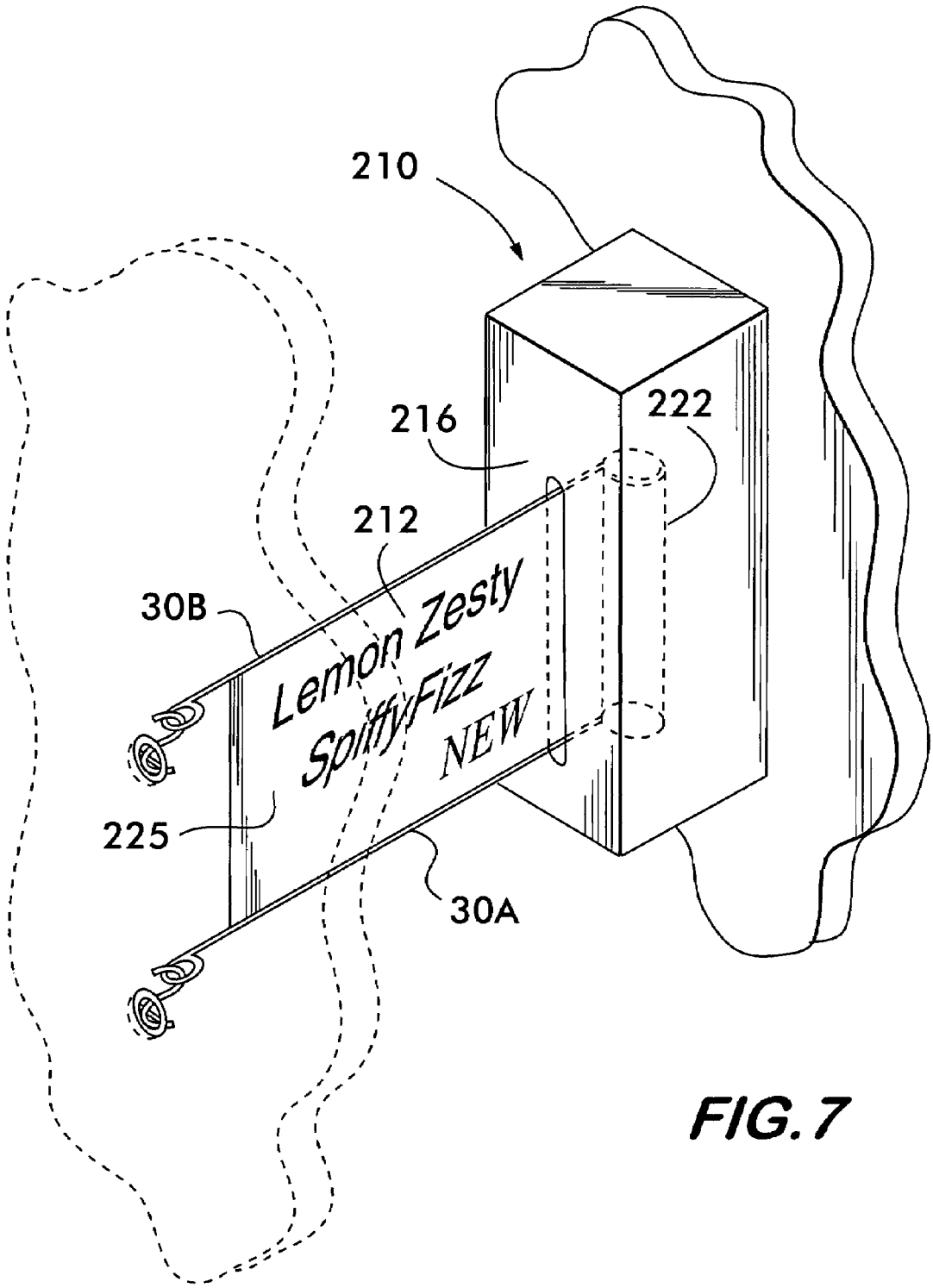
FIG. 7 is an isometric view the stowable antenna system of FIG. 6, shown in a vertically mounted orientation.

The housing 16 may be mounted such that the electronic radiating element 12 extends in substantially any direction. As can be seen in FIGS. 1, 2, and 3, the radiating element 12 may extend upwardly from the housing. As can be seen in FIG. 6, the radiating element 212 may extend downwardly (for example, from a ceiling). As can be seen in FIG. 7 (which is essentially the same as FIG. 6, but hung vertically), the radiating element 212 may extend horizontally. Other configurations in other directions, including angled from the horizontal or vertical are easy to visualize and implement by one skilled in the art.

Figure 5:
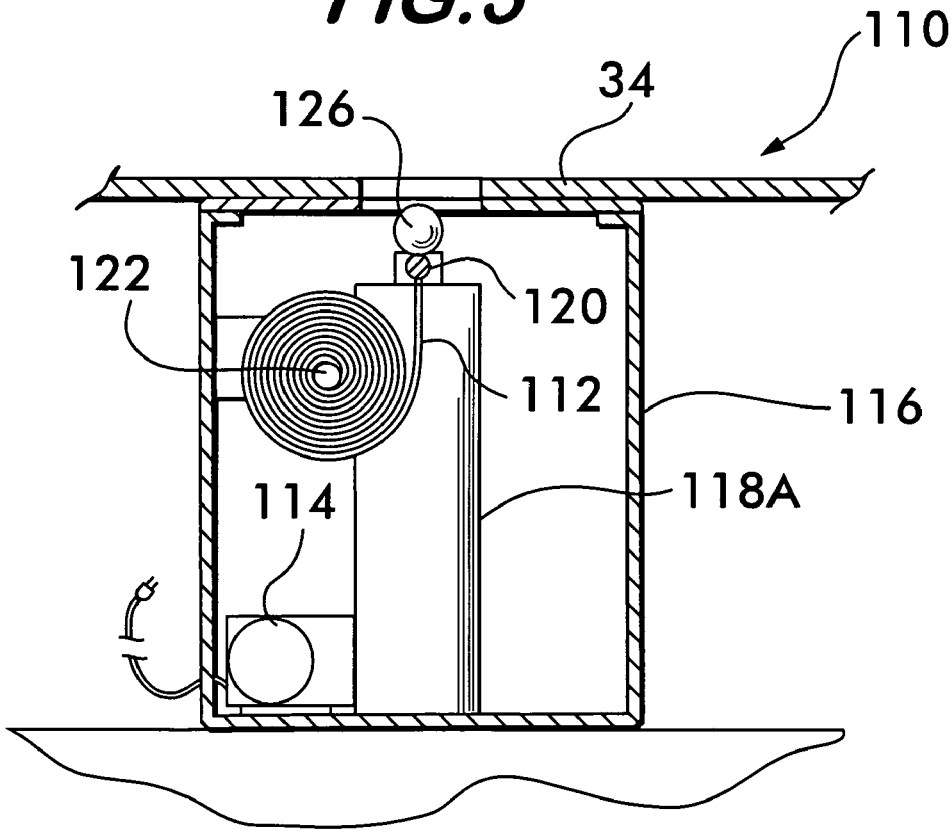
FIG. 5 is a cross sectional view of stowable antenna system in accordance with a second preferred embodiment of the present invention.

It is highly desirable that the system be portable. That is, it is preferable that the housing be easy to lift and load without the use of ancillary equipment. However, it is also contemplated in an alternate embodiment of the present invention that the system 110 of the present invention be adapted to be buried underground. Here, the housing 116 has a cover 34, as shown in FIG. 5, to provide access to unfurl the electronic radiating element from above ground level. This is particularly beneficial for use in retail stores, such as home improvement stores where carts requiring an excessively wide aisle width are often required. Again, similar to the embodiment of FIG. 6, in the embodiment of FIG. 5, for simplicity sake, like elements to that of the embodiment of FIG. 1 use the same reference number with a "1" as a prefix. For example, the housing of FIG. 1 was designated 16. The housing of FIG. 5 is designated 116.

Finally, it is preferable that the power supply of the system is operable utilizing standard 110 volt AC power, for example, from a standard 110 volt wall outlet. However, other power systems, including battery power, are contemplated.

In one particularly preferred embodiment, the radiating element of the sheet antenna is constructed in accordance with the disclosure of U.S. Application Publication No. 2003/0051806, published on Mar. 20, 2003, entitled Security Tag and Process for Making Same, assigned to Checkpoint Systems, Inc. of Thorofare, N.J., the complete specification of which is fully incorporated by reference in its entirety. Here, the radiating element is made using the steps of forming an adhesive layer in a predetermined pattern (i.e., in the shape of the radiating element) on a surface of a substrate (i.e., the sheet), laminating a conductive foil to the surface of the sheet to form a conductive layer, forming a portion of the conductive layer in a shape generally corresponding to the predetermined pattern and removing a portion of the conductive layer that does not correspond to the portion of the conductive layer that corresponds to the predetermined pattern of the adhesive (i.e., cutting away the first conductive layer where there is no adhesive).

One large advantage of using this particular embodiment is that the substantial inefficiencies of the prior art practice of etching away a conductive layer is avoided. This is particularly important for large antennas. For example, the environmental concerns of hazardous waste associated with etching are avoided and the losses of the conductive material are substantially reduced.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. A stowable antenna system for a security system, comprising:

(A) an electronic radiating element in the form of a flexible sheet, said flexible sheet being furlable;

(B) a power supply to power the electronic radiating element;

(C) a housing to receive and store the radiating element in a furled condition and wherein said radiating element is stowable in a furled condition and is extendable to an unfurled condition for use in the security system, wherein the housing is adapted to be under ground level and wherein the housing has a cover to provide access to unfurl the electronic radiating element to a position above the ground level.

2. A stowable antenna system for a security system, comprising:

(A) an electronic radiating element in the form of a flexible sheet, said flexible sheet being furlable;

(B) a power supply to power the electronic radiating element;

(C) a housing to receive and store the radiating element in a furled condition and wherein said radiating element is stowable in a furled condition and is extended to an unfurled condition for use in the security system, wherein the housing is adapted to be under ground level and wherein the housing has a cover to provide access to unfurl the electronic radiating element to a position above the ground level;

(D) at least one riser extending from the housing for supporting the radiating element in the unfurled condition;

(E) wherein the electronic radiating element is received in the housing and stored in the housing in a rolled up, windowshade configuration.

* * * * *